United States Patent [19]

Haltof

[11] Patent Number: 4,517,766

[45] Date of Patent: May 21, 1985

[54] ADJUSTABLE FRICTION SASH HOLDER

[75] Inventor: Garry P. Haltof, Rochester, N.Y.

[73] Assignee: Caldwell Manufacturing Company, Rochester, N.Y.

[21] Appl. No.: 550,441

[22] Filed: Nov. 10, 1983

[51] Int. Cl.[3] ..... E05D 13/08

[52] U.S. Cl. ..... 49/417; 49/421

[58] Field of Search ..... 49/414, 417, 421, 428–431, 49/445, 451

[56] References Cited

U.S. PATENT DOCUMENTS

| | | | |
|---|---|---|---|
| 2,352,171 | 6/1944 | Anfinson . | |
| 2,372,634 | 3/1945 | Breitenbach et al. | 49/417 X |
| 2,651,535 | 9/1953 | Padjen . | |
| 2,913,781 | 11/1959 | Czubachowski . | |
| 3,007,194 | 11/1961 | Griswold . | |
| 3,407,434 | 10/1968 | Scott . | |
| 3,466,806 | 9/1969 | Teggelaar et al. . | |
| 3,501,867 | 3/1970 | Scott . | |
| 3,788,006 | 1/1974 | Teggelaar et al. | 49/417 |
| 3,991,521 | 11/1976 | Crosby . | |

*Primary Examiner*—Kenneth Downey

*Attorney, Agent, or Firm*—Stonebraker, Shepard & Stephens

[57] ABSTRACT

A holder 10 for a sash 11 running in a resin jamb liner 12 applies adjustable friction to a track 20 in the sash plow region of the sash run of the jamb liner. Track 20 has parallel edge guides 21 that are L-shaped in cross section to project from the sash run and extend toward each other. Holder 10 includes a carriage 25 that fits within the plow 19 of sash 11, and carriage 25 has a pair of runners 27 and 28 whose lateral edges are trapped under guides 21 to confine the runners to vertical movement along the track. Carriage 25 also has a friction shoe 35 variably pressed against the sash run surface of the track by an adjustment screw 15. Balance spring 13 pulls upward on carriage 25; and platform 26, connected to carriage 25 by adjustment screw 15, straddles plow 19 and supports the lower corner of sash 11. Screw 15 adjusts the friction of holder 10 within the sash run by the pressure it applies to friction shoe 35.

7 Claims, 3 Drawing Figures

ADJUSTABLE FRICTION SASH HOLDER

BACKGROUND

A window sash running in a resin jamb liner and counterbalanced by springs needs some friction to hold a set position. Without friction, the springs would balance the sash in a position about half open; but friction between the sash and the jamb liner can hold the sash anywhere from closed to wide open. A larger and heavier sash with stronger counterbalance springs needs more friction to hold a set position. Too much friction, however, makes the sash hard to move.

The window art contains many suggestions addressed to the long-standing problem of suitable friction for a spring-balanced, wooden sash; but the proposed solutions all leave several shortfalls. Most friction devices variably expand in the limited space between the jamb liner and the sash stile; but this can deform a resin jamb liner, causing a poor appearance and a possible air leak. Some friction devices are not adjustable so that they have to be made in several sizes for different size windows. Other friction devices can be adjusted only by taking the window apart; and many friction devices are complex, expensive, short-lived, or unreliable.

My sash holder provides a friction adjustment that is accessible and convenient, accommodates a wide range of spring forces, and can be varied while the sash is mounted in an operating position. My holder is also economical to manufacture, easy to install, and rugged and serviceable. It uses few components, requires no attachment to the sash, and adapts automatically to both upper and lower sashes so as to be practically universal.

SUMMARY OF THE INVENTION

My adjustable friction sash holder is usable with a sash running in a resin jamb liner having a track in a sash plow region of the sash run of the jamb liner. The track is formed by parallel guides that are L-shaped in cross section to project from the sash run and extend toward each other along opposite sides of the track. My holder includes a carriage that fits within the sash plow and has a pair of vertically spaced runners. Opposite lateral edges of the runners run along lateral sides of the track and interlock with the guides, which confine the runners to vertical movement along the track. Between the runners, the carriage has a movable friction shoe that engages the sash run surface of the track between the guides. The carriage connects to a balance spring at its upper end and a sash platform at its lower end, and the platform straddles the sash plow at a lower corner of the sash. The head of an adjustment screw holds the platform, and the screw threads into the carriage to engage the friction shoe. The threaded advance of the screw then variably forces the friction shoe against the track and the runners against the guides to adjust the friction of the holder within the sash run.

DRAWINGS

DETAILED DESCRIPTION

Figure 1:
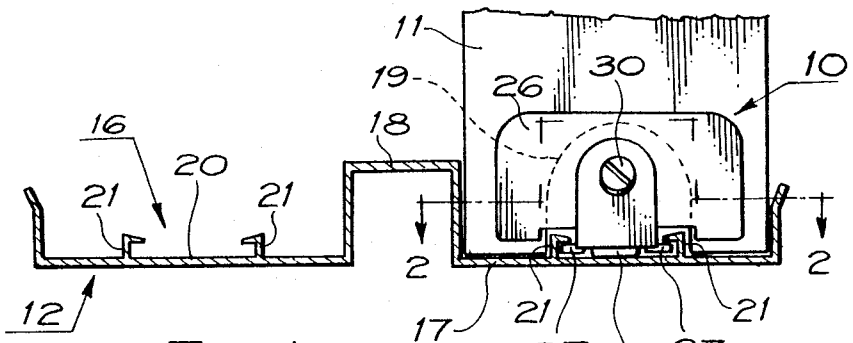
FIG. 1 is a fragmentary and partially sectioned bottom view of a sash held in a jamb liner with a preferred embodiment of my adjustable friction sash holder.

A preferred embodiment of my sash holder 10 as shown in the drawings holds a sash 11 in a resin jamb liner 12 with an adjustable friction that keeps the sash set at any position. Adjustment screw 15 accomplishes this as explained following the description of the structures of holder 10 and jamb liner 12.

Extruded resin jamb liner 12 extends vertically within a window frame and includes a pair of sash runs 16 and 17 separated by a parting bead 18. For illustrative purposes in FIG. 1, lower sash 11 is mounted in sash run 17, and upper sash run 16 is empty. Each sash run has a track 20 in a sash plow region, where the sash stile has a plow groove 19 that clears a balance spring and a spring cover (not shown) in the upper half of the sash run. Tracks 20 have parallel edge guides 21 that are L-shaped in cross section to project from the sash run and extend toward each other along opposite sides of track 20.

Holder 10 includes a carriage 25 that fits within plow groove 19 in the stile of sash 11 and a platform 26 that straddles plow 19 at a lower corner of sash 11. Sash 11 rests its weight on platforms 26 at opposite lower corners of sash 11. A balance spring 13, that can have several different forms, connects to an upper region of carriage 25 and pulls upward on carriage 25 and platform 26 to balance sash 11.

Carriage 25 has a pair of vertically spaced runners 27 and 28 that run up and down track 20 with sash 11. The lateral edges of runners 27 and 28 interlock with and guide against L-shaped guides 21 that confine the runners to vertical movement along track 20.

Adjustment screw 15 connects platform 26 and carriage 25. The head 30 of screw 15 holds platform 26, and screw 15 threads into carriage 25, which has threaded regions 31 and 32 molded to face screw 15 from opposite sides of carriage 25.

Figure 2:
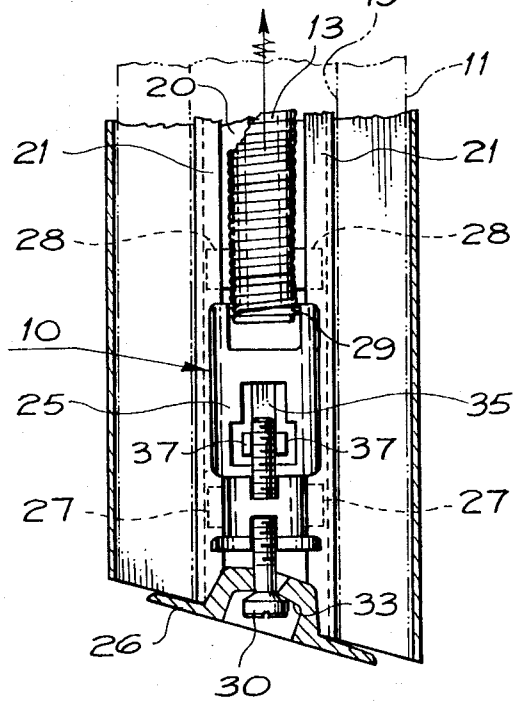
FIG. 2 is a view of the sash and holder of FIG. 1, showing a cross section of the platform, taken along the line 2—2 thereof.

Screw 15 preferably has a modified pan head 30 as illustrated with an angle A on the bottom side of head 30 that is preferably about 14°, which is a conventional angle for a window sill. Platform 26 engaging head 30 with platform surface 33 can tilt 14° in either lateral direction relative to carriage 25 as best shown in FIG. 2. A single tiltable platform thus accommodates the opposite angles encountered on opposite ends of a lower sill rail and makes holder 10 universal.

Platform 26 is preferably molded integrally with carriage 25 via a breakaway connection 24 that keeps the two parts together until interconnected by screw 15. As platform 26 tilts to engage the lower rail of a lower sash 11 as shown in FIG. 2, connection 24 can break, leaving platform 26 connected to carriage 25 by screw 15.

Figure 3:
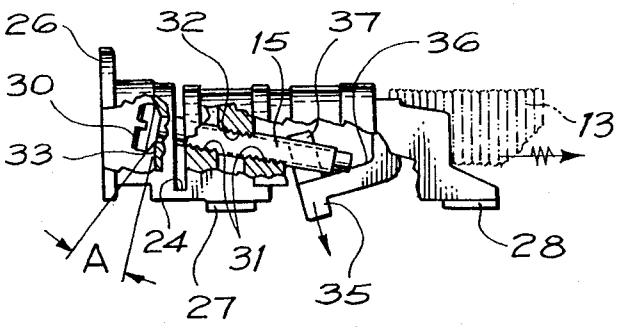
FIG. 3 is a partially cutaway side elevational view of the holder of FIG. 2.

Carriage 25 has a friction shoe 35 that is generally L-shaped as best shown in FIG. 3 and extends resiliently from an upper region of carriage 25. Screw 15 engages upper surface 36 of friction shoe 35 so that the threaded advance of screw 15 presses friction shoe 35 against track 20 with an adjustable pressure. Friction shoe 35 engages the sash run surface of track 20 between guides 21 and between runners 27 and 28. Ears 37 extending from friction shoe 35 straddle screw 15 to help prevent friction shoe 35 from moving laterally of screw 15. As friction shoe 35 presses harder against track 20, runners 27 and 28 are pressed harder against guides 21. The total resistance to movement of runners 27 and 28 pressed against guides 21 and friction shoe 35 pressed against track 20 determines the frictional holding ability of holder 10.

Holder 10 assembles by advancing screw 15 through platform 26 and into carriage 25 to engage surface 36 of friction shoe 35. Runners 27 and 28 slide into an open end of track 20 under guides 21, and spring 13 connects to connector 29 at the upper end of carriage 25 and to a corresponding connector (not shown) at the upper end of jamb liner 12.

When sash 11 is assembled into sash run 17, its plow regions at its lower corners engage platforms 26 without requiring any interconnection. Screw head 30 is accessible at each lower corner of sash 11 for adjusting friction by advancing or retracting from friction shoe 35.

Once assembled into jamb liner 12, sash 11 can be moved up and down to test the frictional adjustment of holders 10. Turning screw heads 30 can change this without any dismounting or disassembly. Moving sash 11 can quickly determine whether the frictional adjustment is correct.

Any deformation or stress from the frictional adjustment of holder 10 occurs only between track 20 and guides 21. This does not deform jamb liner 12 to allow air leakage or subject the jamb liner to deteriorating wear.

I claim:

1. An adjustable friction sash holder for use with a sash running in a resin jamb liner having a track in a sash plow region of the sash run of said jamb liner, said track being formed by parallel guides that are L-shaped in cross section to project from said sash run and extend toward each other along opposite sides of said track, said holder comprising:

a. a carriage shaped to fit within said plow region of said sash;

b. said carriage having a pair of runners spaced vertically apart;

c. each of said runners having opposite lateral edges disposed for running along lateral sides of said track, said lateral edges of said runners being interlocked with said L-shaped guides to confine said runners to vertical movement along said track;

d. said carriage having a friction shoe arranged between said runners;

e. said friction shoe being movable relative to said runners to engage a sash run surface of said track between said L-shaped guides;

f. a balance spring connection arranged at an upper region of said carriage;

g. a platform arranged at a lower region of said carriage;

h. said platform being dimensioned to straddle said sash plow region at a lower corner of said sash;

i. an adjustment screw having a head holding said platform;

j. said adjustment screw being threaded into said carriage; and k. an end of said adjustment screw opposite said head engaging said friction shoe so that the threaded advance of said screw variably biases said friction shoe against said track to adjust the friction of said holder within said sash run.

2. The holder of claim 1 wherein said carriage is molded of resin material, and thread regions of said carriage for receiving said screw are formed to face said screw from opposite sides of said carriage.

3. The holder of claim 1 wherein said friction shoe is generally L-shaped with one end resiliently joined to said carriage and another end pivotally disposed to engage said track.

4. The holder of claim 3 wherein said carriage is molded of resin material, and thread regions of said carriage for receiving said screw are formed to face said screw from opposite sides of said carriage.

5. The holder of claim 1 wherein said carriage and said platform are molded of resin material giving said platform a breakaway connection to said carriage so that said platform can be disposed at orientations angled relative to said carriage.

6. The holder of claim 5 wherein said friction shoe is generally L-shaped with one end resiliently joined to said carriage and another end pivotally disposed to engage said track.

7. The holder of claim 6 wherein said carriage is molded of resin material, and thread regions of said carriage for receiving said screw are formed to face said screw from opposite sides of said carriage.

* * * * *